US007936241B2

(12) United States Patent
Drexler et al.

(10) Patent No.: US 7,936,241 B2
(45) Date of Patent: May 3, 2011

(54) CONTACTOR WITH CONDUCTOR CHANNEL AND LOAD BRANCH CIRCUIT WITH A CONTACTOR OF THIS TYPE

(75) Inventors: Johann Drexler, Schwandorf (DE); Stephan Faber, Kümmersbruck (DE); Alexander Oberleiter, Thalheim (DE)

(73) Assignee: Siemens Aktiengesellschaft, Munich (DE)

( * ) Notice: Subject to any disclaimer, the term of this patent is extended or adjusted under 35 U.S.C. 154(b) by 96 days.

(21) Appl. No.: 12/000,225

(22) Filed: Dec. 11, 2007

(65) Prior Publication Data

US 2008/0238590 A1 Oct. 2, 2008

(30) Foreign Application Priority Data

Mar. 30, 2007 (EP) ..... 07006733

(51) Int. Cl.

| | |
|---|---|
| ***H01H 9/02*** | (2006.01) |
| ***H01H 13/04*** | (2006.01) |
| ***H01H 1/64*** | (2006.01) |
| ***H01H 1/66*** | (2006.01) |
| ***H01H 13/00*** | (2006.01) |

(52) U.S. Cl. ..... 335/202; 200/293

(58) Field of Classification Search ..... 335/6, 127, 335/202; 200/293–294

See application file for complete search history.

(56) References Cited

U.S. PATENT DOCUMENTS

| | | | | |
|---|---|---|---|---|
| 3,296,565 | A * | 1/1967 | Kiesel et al. | 335/69 |
| 4,345,225 | A * | 8/1982 | Lemmer | 335/132 |
| 5,012,215 | A * | 4/1991 | Floc'h | 335/132 |
| 5,652,420 | A * | 7/1997 | Innes et al. | 200/50.32 |
| 5,834,998 | A * | 11/1998 | Reiss et al. | 335/78 |
| 5,875,885 | A * | 3/1999 | Changle et al. | 200/293 |
| 6,034,584 | A * | 3/2000 | Hilfiker | 335/132 |
| 6,285,271 | B1 * | 9/2001 | Bauer et al. | 335/132 |
| 6,310,528 | B1 * | 10/2001 | Kuboyama et al. | 335/132 |
| 6,512,433 | B1 * | 1/2003 | Bouchard et al. | 335/6 |
| 6,621,393 | B2 * | 9/2003 | Comtois et al. | 335/132 |
| 6,784,770 | B2 * | 8/2004 | Gimenez et al. | 335/18 |
| 6,825,745 | B1 | 11/2004 | Bach et al. | |

FOREIGN PATENT DOCUMENTS

| | | |
|---|---|---|
| CN | 1353856 | 6/2002 |
| EP | 1 181 704 | 4/2003 |
| JP | 05-002979 | 1/1993 |
| JP | 05-258657 | 10/1993 |
| JP | 08-250013 | 9/1996 |
| WO | WO 01/39232 | 5/2001 |

OTHER PUBLICATIONS

Office Action for Chinese patent application No. 200710195963.1 dated Nov. 4, 2010 (in German).

* cited by examiner

*Primary Examiner* — Elvin G Enad
*Assistant Examiner* — Alexander Talpalatskiy
(74) *Attorney, Agent, or Firm* — Harness, Dickey & Pierce, P.L.C.

(57) ABSTRACT

A contactor includes a housing having a mounting side, an operating side, main connector surfaces and side surfaces. The operating side lies opposite the mounting side and is connected to the mounting side by main connector surfaces and side surfaces. The main connector surfaces lie opposite one another and the side surfaces lie opposite one another. The operating side has a raised central area and two edge areas, which border a central area on both sides of the central area. The edge areas border the main connector areas and are connected to the central area by way of an additional connector area in each case. Main terminals, connected to load contacts of the contactor, have main receptacle openings into which main conductors are fed from one of the main connector surfaces. Additional terminals have receptacle openings into which additional conductors are fed from additional connector surfaces.

16 Claims, 3 Drawing Sheets

FIG 3 (I)
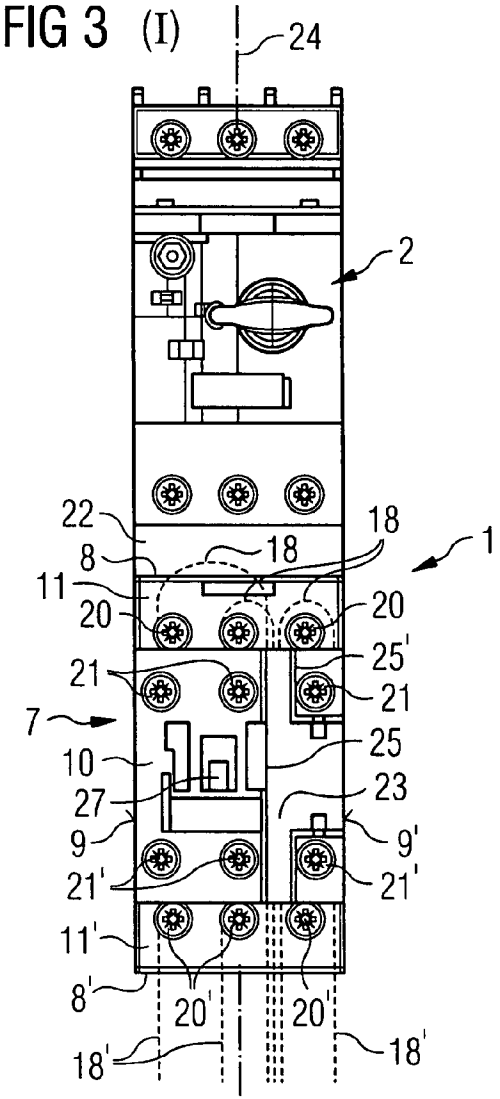
FIG 2 (II)
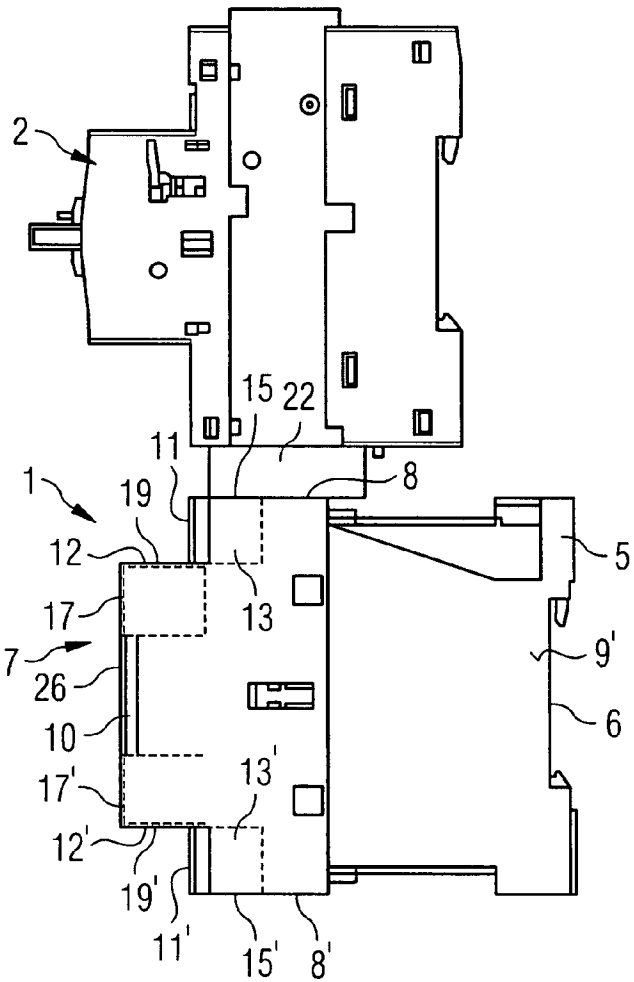

CONTACTOR WITH CONDUCTOR CHANNEL AND LOAD BRANCH CIRCUIT WITH A CONTACTOR OF THIS TYPE

PRIORITY STATEMENT

The present application hereby claims priority under 35 U.S.C. §119 on European patent application number EP07006733 filed Mar. 30, 2007, the entire contents of which is hereby incorporated herein by reference.

FIELD

Embodiments of the present invention generally relate to a contactor. For example, it may relate to one which is constructed as follows:

- It has a housing, which has a mounting side, an operating side, two main connector surfaces and two side surfaces.
- The operating side lies opposite the mounting side and is connected to the mounting side by means of the main connector surfaces and the side surfaces, wherein the main connector surfaces lie opposite one another and the side surfaces lie opposite one another.
- The operating side has a raised central area and two edge areas, which border the central area on both sides of the central area, wherein the edge areas border the main connector areas and are connected to the central area via an additional connector area in each case.
- Main terminals, which are connected to the load contacts of the contactor, have main receptacle openings into which main conductors can be fed from one of the main connector surfaces in each case.
- Additional terminals, by which additional conductors can be connected to the contactor, have additional receptacle openings into which the additional conductors can be fed from one of the additional connector surfaces in each case.

Furthermore, the present invention generally relates to a load branch circuit including a contactor of the type described above and an additional device. For example, it may relate to one

- wherein the additional device is mechanically and electrically connected to the contactor to one of the main connector surfaces,
- wherein at least one additional conductor is clamped in one of the additional terminals facing the additional device.

BACKGROUND

Contactors and load branch circuits are generally known. In the case of the contactor, main actuating elements, by which the main terminals can be actuated, are often accessible from the edge areas. Furthermore, additional actuating elements, by means of which the additional terminals can be actuated, are often accessible from the central area.

As a rule, conductors are clamped in the additional terminals of both additional connector areas. At least those additional conductors, which are clamped in an additional terminal facing the additional device, must therefore be fed either over the central area and the edge area facing away from the additional device or over the additional device. This procedure is disadvantageous, as it adversely affects access to the contactor or to the additional device and impairs the view of the contactor or the additional device. Furthermore, this embodiment is unaesthetic.

SUMMARY

In at least one embodiment of the present invention a facility is created for avoiding the above-mentioned disadvantages.

In at least one embodiment, a conductor channel, which extends from one of the edge areas to the other edge area, is introduced in the central area.

Correspondingly, in at least one embodiment, the contactor is constructed as last described and the at least one additional conductor is fed through the conductor channel.

In at least one embodiment, as a rule, the conductor channel runs parallel to the side surfaces. In doing so, it can be arranged centrally with reference to the side surfaces. In at least one embodiment, however, the conductor channel is arranged closer to the one side surface than to the other side surface.

In at least one embodiment, the conductor channel has a channel wall facing the one side surface and a channel wall facing the other side surface. Preferably even, the channel wall facing the other side surface is arranged closer to the one side surface than to the other side surface.

In at least one embodiment, the contactor has a plunger. In many cases, the plunger is accessible from the central area. In the case of the contactor according to at least one embodiment, the plunger is preferably arranged closer to the other side surface than to the one side surface.

It can be possible to cover the conductor channel by way of a flap. In doing so, it is possible for the flap to cover the conductor channel and other elements—for example the whole central area. Preferably, however, it is possible to cover only the conductor channel by means of the flap.

BRIEF DESCRIPTION OF THE DRAWINGS

Further advantages and details can be seen from the following description of example embodiments in conjunction with the drawings. In the form of a simplified diagram:

FIG. 2 shows the load branch circuit of FIG. 1 from the side,

FIG. 3 shows the load branch circuit of FIG. 1 from the front,

DETAILED DESCRIPTION OF THE EXAMPLE EMBODIMENTS

Figure 1:
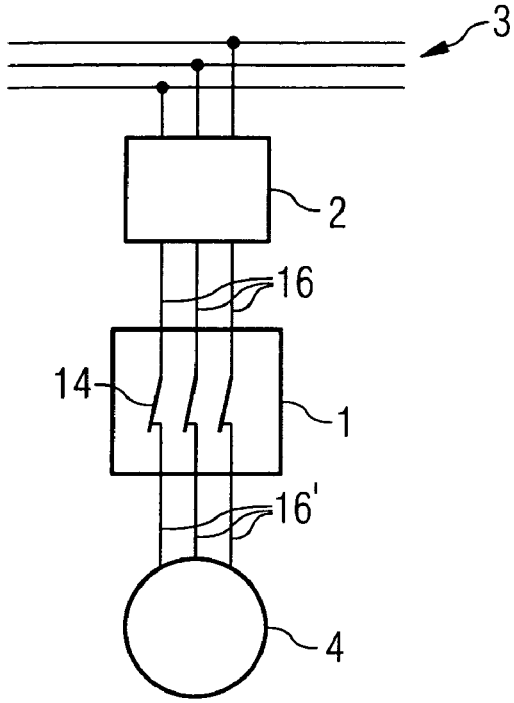
FIG. 1 shows schematically a first load branch circuit.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

According to FIG. 1, a load branch circuit has a contactor 1 and an additional device 2. The load branch circuit is arranged between an electricity network 3 and a load 4. According to FIG. 1, the additional device 2 is designed as a circuit breaker. It is arranged upstream of the contactor 1.

According to FIG. 2 and 3, the contactor 1 has a housing 5. The housing 5 has a mounting side 6, an operating side 7, two main connector surfaces 8, 8' and two side surfaces 9, 9'. The operating side 7 lies opposite the mounting side 6. It is connected to the mounting side 6 by means of the main connector surfaces 8, 8' and the side surfaces 9, 9'. The main connector surfaces 8, 8' lie opposite one another. Likewise, the side surfaces 9, 9' lie opposite one another.

The operating side 7 has a raised central area 10 and two edge areas 11, 11', which border the central area 10 on both sides of the central area 10. The edge areas 11, 11' border the main connector areas 8, 8'. They are connected to the central area 10 by way of an additional connector area 12, 12' in each case.

Schematically shown main terminals 13, 13', which are connected to load contacts 14 of the contactor 1, have main receptacle openings 15, 15'. Main conductors 16, 16' can be fed into the main receptacle openings 15, 15'. The ability to feed in these conductors is provided here in each case by one of the main connector surfaces 8, 8'.

Furthermore, the contactor 1 has schematically shown additional terminals 17, 17'. Additional conductors 18, 18' can be connected to the contactor 1 by means of the additional terminals 17, 17'. The additional conductors 18, 18' are used, for example, to take off auxiliary signals, to feed in an energy supply and, if necessary, to separately feed in a control signal for the contactor 1. The additional terminals 17, 17' have additional receptacle openings 19, 19' into which the additional conductors 18, 18' can be fed. Here, the additional conductors 18, 18' can be fed into the additional receptacle openings 19, 19' from one of the additional connector surfaces 12, 12' in each case.

In many cases, the main terminals 13, 13' are designed as screw terminals. In this case in particular, main actuating elements 20, 20' (namely screws), by which the main terminals 13, 13' can be actuated, are accessible from the edge areas 11, 11'.

Furthermore, in many cases, the additional terminals 17, 17' are likewise designed as screw terminals. In this case in particular, additional actuating elements 21, 21' (namely once again screws), by which the additional terminals 17, 17' can be actuated, are accessible from the central area 10.

The additional device 2 is mechanically and electrically connected with the contactor 1 to one of the main connector surfaces 8, 8'. In doing so, an intermediate element 22, which effects the electrical and mechanical connection of the additional device 2 to the contactor 1, can be arranged between the contactor 1 and the additional device 2 if necessary.

According to FIG. 2, a conductor channel 23 is introduced in the central area 10, which extends from one of the edge areas 11, 11' to the other edge area 11, 1'. At least one of the additional conductors 18, which is clamped in one of the additional terminals 17 facing the additional device 2, is fed through the conductor channel 23.

A center line, which runs centrally between the side surfaces 9, is designated with the reference 24. It can be seen that the conductor channel 23 runs parallel to the side surfaces 9 but is arranged off center, namely nearer to the one side surface 9 than to the other side surface 9'.

The conductor channel 23 has two channel walls 25, 25'. The one channel wall 25 faces the one side surface 9, the other channel wall 25' faces the other side surface 9'. The channel wall 25' facing the other side surface 9' is arranged nearer to the one side surface 9 than to the other side surface 9'. In the embodiment of FIG. 2 and 3, the conductor channel 23 in its entirety is therefore arranged closer to the one side surface 9 than to the other side surface 9'.

The conductor channel 23 can preferably be covered by means of a flap 26. Preferably, in doing so, it is possible to cover only the conductor channel 23 by means of the flap 26. However, it would alternatively be possible to also cover other elements—in particular the whole central area 10—with the flap 26.

The contactor 1 has a plunger 27. According to FIG. 3, the plunger 27 is accessible from the central area 10. Here, the plunger 27 is arranged closer to the other side surface 9' than to the one side surface 9. An auxiliary device, which can be placed on either side of the contactor 1, can be actuated via the plunger 27.

Figure 4:
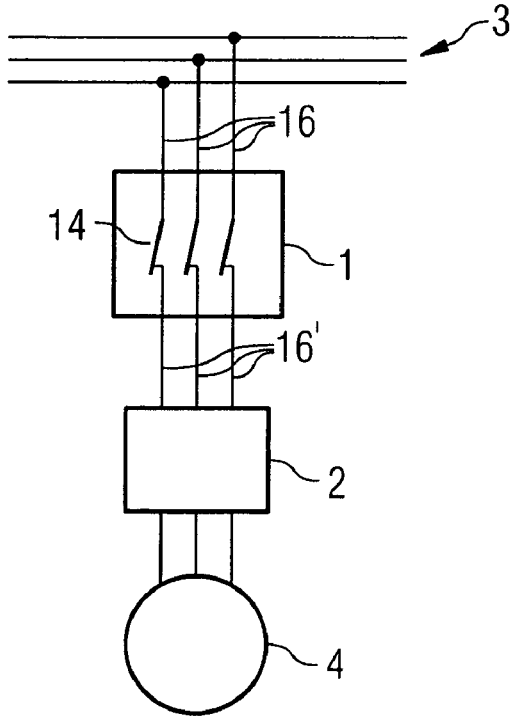
FIG. 4 shows schematically a further load branch circuit.
Figure 6:
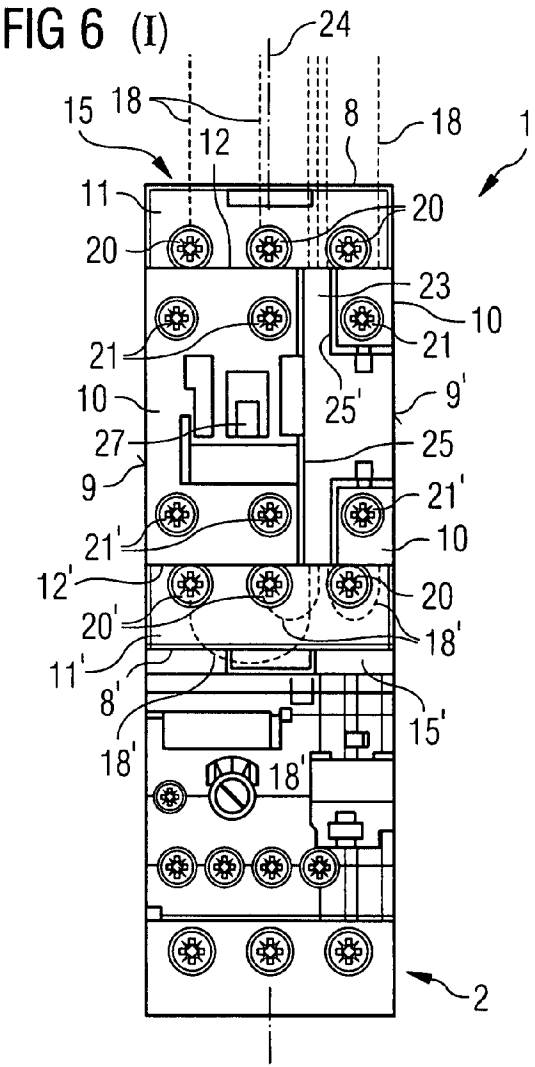
FIG. 6 shows the load branch circuit of FIG. 4 from the front.
Figure 5:
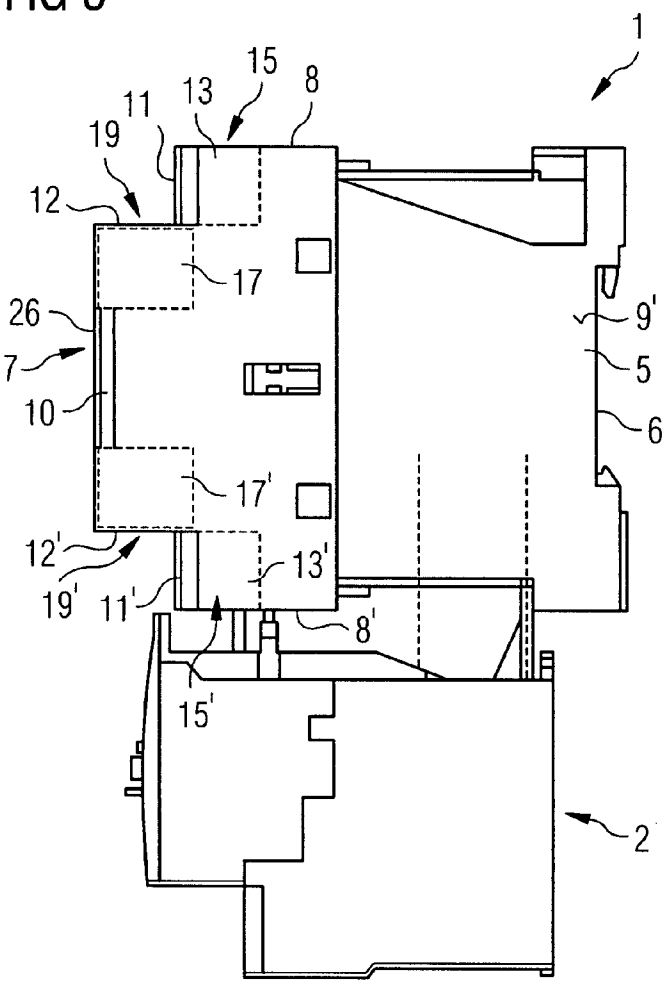
FIG. 5 shows the load branch circuit of FIG. 4 from the side.

The embodiment according to FIG. 4 to 6 is essentially the same as the embodiment of FIG. 1 to 3. The only differences reside in the fact that

- the additional device 2 is not designed as a circuit breaker but as an overload relay, and
- the additional device 2 is not connected upstream of the contactor 1 but downstream.

In principle, the two differences between the embodiment of FIG. 4 to 6 compared with the embodiment of FIG. 1 to 3 can be realized independently of one another. However, as a rule, they are realized in combination.

The above description serves exclusively to explain the present invention. However, the scope of protection of the present invention is to be defined exclusively by the attached claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A contactor, comprising:

a housing, including a mounting side, an operating side, two main connector surfaces and two side surfaces, the operating side lying opposite the mounting side and being connected to the mounting side via the main connector surfaces and the side surfaces, the main connector surfaces lying opposite one another and the side surfaces lying opposite one another, the operating side including a raised central area and two edge areas which border the central area on both sides of the central area, wherein the edge areas border the main connector surfaces and are connected to the central area via an additional connector area;

main terminals, connected to the load contacts of the contactor, including main receptacle openings into which main conductors are feedable from one of the main connector surfaces;

additional terminals, by which additional conductors are connectable to the contactor, including additional receptacle openings into which the additional conductors are feedable from one of the additional connector surfaces; and a conductor channel, extending from one of the edge areas to the other edge area, introduced in the central area.

2. The contactor as claimed in claim 1, wherein the conductor channel runs parallel to the side surfaces.

3. The contactor as claimed in claim 2, wherein the conductor channel is arranged relatively closer to the one side surface than to the other side surface.

4. The contactor as claimed in claim 3, wherein the conductor channel includes a channel wall facing the one side surface and a channel wall facing the other side surface and wherein the channel wall facing the other side surface is arranged closer to the one side surface than to the other side surface.

5. The contactor as claimed in claim 3, wherein the contactor includes a plunger, accessible from the central area and arranged relatively closer to the other side surface than to the one side surface.

6. The contactor as claimed in claim 1, wherein the conductor channel is covered by a flap.

7. The contactor as claimed in claim 6, wherein only the central area is covered by the flap.

8. The contactor as claimed in claim 1, further comprising main actuating elements, by which the main terminals are actuatable, accessible from the edge areas.

9. The contactor as claimed in claim 1, further comprising additional actuating elements, by which the additional terminals are actuatable, accessible from the central area.

10. A load branch circuit comprising:

a contactor as claimed in claim 1; and an additional device mechanically and electrically connected to one of the main connector surfaces of the contactor, wherein at least one additional conductor is clamped in one of the additional terminals facing the additional device and is fed through the conductor channel.

11. The contactor as claimed in claim 4, wherein the contactor includes a plunger, accessible from the central area and arranged relatively closer to the other side surface than to the one side surface.

12. The contactor as claimed in claim 8, further comprising additional actuating elements, by which the additional terminals are actuatable, accessible from the central area.

13. The contactor as claimed in claim 1, wherein the additional terminals are covered by a flap on the central area.

14. The contactor as claimed in claim 9, wherein the additional actuating elements are covered by a flap on the central area.

15. The contactor as claimed in claim 8, wherein the main receptacle openings are in the edge areas, and the conductor channel passes between the additional terminals and opens onto the additional connector areas such that the additional terminals are connectable to the main actuating elements.

16. The load branch circuit as claimed in claim 10, wherein the additional device is arranged at least one of above and below the contactor.

* * * * *